US008112279B2

(12) United States Patent
Addessi et al.

(10) Patent No.: US 8,112,279 B2
(45) Date of Patent: Feb. 7, 2012

(54) AUTOMATIC CREATION OF AUDIO FILES

(75) Inventors: Jamie M Addessi, Burlington, VT (US); Mark Paul Bonfigli, Burlington, VT (US); Richard F Gibbs, Jr., Huntington, VT (US); Christopher Nathaniel Scott, Williston, VT (US)

(73) Assignee: Dealer Dot Com, Inc., Burlington, VT (US)

( * ) Notice: Subject to any disclaimer, the term of this patent is extended or adjusted under 35 U.S.C. 154(b) by 828 days.

(21) Appl. No.: 12/192,783

(22) Filed: Aug. 15, 2008

(65) Prior Publication Data

US 2010/0042411 A1 Feb. 18, 2010

(51) Int. Cl.
*G10L 13/00* (2006.01)

(52) U.S. Cl. ..... 704/260; 704/258; 725/42

(58) Field of Classification Search ..... 704/258, 704/260; 725/42

See application file for complete search history.

(56) References Cited

U.S. PATENT DOCUMENTS

| | | | | |
|---|---|---|---|---|
| 2004/0226048 | A1 | 11/2004 | Alpert | |
| 2005/0027591 | A9 * | 2/2005 | Gailey et al. | 705/14 |
| 2006/0136556 | A1 * | 6/2006 | Stevens et al. | 709/203 |
| 2008/0101563 | A1 * | 5/2008 | Smith | 379/88.18 |
| 2008/0109845 | A1 | 5/2008 | Hengel | |

FOREIGN PATENT DOCUMENTS

WO WO2006/116796 A1 11/2006

* cited by examiner

*Primary Examiner* — Daniel D Abebe
(74) *Attorney, Agent, or Firm* — James Marc Lees

(57) ABSTRACT

A method of building an audio description of a particular product of a class of products includes providing a plurality of human voice recordings, wherein each of the human voice recordings includes audio corresponding to an attribute value common to many of the products. The method also includes automatically obtaining attribute values of the particular product, wherein the attribute values reside electronically. The method also includes automatically applying a plurality of rules for selecting a subset of the human voice recordings that correspond to the obtained attribute values and automatically stitching the selected subset of human voice recordings together to provide a voiceover product description of the particular product. A similar method is used to build an audio description of a particular process.

41 Claims, 4 Drawing Sheets

```
<scriptTemplate name="sampleTemplate" language="US_ENGLISH"
datasource="com.dealer.audiorenderer.datasources.VehicleScriptDataSourc
e">
    <paragraph name="Intro" required="true">
        <list min="1" max="1" name="Year Intro" required="true">
            <fragment text="The 2007" src="yearintros/2007.wav"
criteria="inv.year==2007"/>
            <fragment text="The 2008" src="yearintros/2008.wav"
criteria="inv.year==2008"/>
            <fragment text="The 2009" src="yearintros/2009.wav"
criteria="inv.year==2009"/>
            <fragment text="The 2010" src="yearintros/2010.wav"
criteria="inv.year==2010"/>
        </list>
        <fragment silence="0.1"/>
        <list min="1" max="1" name="Vehicle" required="true">
            <fragment text="BWM 328 i Sedan"
src="makemodelbody/bmw328isedan.wav"
criteria="inv.make==BMW,inv.model==328i,inv.body==Sedan"/>
            <fragment text="Honda Accord"
src="makemodelbody/hondaaccord.wav"
criteria="inv.make==Honda,inv.model==Accord,inv.body==Sedan"/>
            <fragment text="Dodge Dakota Truck Standard Cab"
src="makemodelbody/dodgedakotatruckstandardcab.wav"
criteria="inv.make==Dodge,inv.model==Dakota,inv.body==Truck"/>
            <fragment text="Nissan 200 SX Coupe"
src="makemodelbody/nissan200sxcoupe.wav"
criteria="inv.make==Nissan,inv.model==200,inv.body==Coupe"/>
        </list>
    </paragraph>

    <fragment silence="0.5"/>

    <paragraph name="Background" required="false" weight="100">
        <list min="1" max="1" name="Doors" required="true">
            <fragment text="This 4 door, 5 passenger vehicle"
src="doors/4door5pass.wav" criteria="inv.doors==4,inv.passengers==5"/>
            <fragment text="This 4 door vehicle" src="doors/4door.wav"
criteria="inv.doors==4"/>
            <fragment text="This 2 door vehicle" src="doors/2door.wav"
criteria="inv.doors==2"/>
        </list>
        <fragment silence="0.1"/>
        <list min="1" max="1" name="Mileage" required="true">
            <fragment text="still has less than 10,000 miles."
src="mileage/less10000.wav" criteria="inv.miles<10000"/>
            <fragment text="still has less than 5,000 miles."
src="mileage/less5000.wav" criteria="inv.miles<5000"/>
            <fragment text="is still under manufacturers warranty."
src="mileage/warranty.wav" criteria="inv.warranty==true"/>
            <fragment text="provides exceptional value."
src="mileage/value.wav" criteria=""/>
        </list>
    </paragraph>
```

FIG. 1a

```
    <fragment silence="0.2"/>

    <paragraph name="Technical" required="false" weight="100">
        <list min="1" max="1" name="Transmission" required="true">
            <fragment text="It features an automatic transmission,"
src="transmission/automatic.wav" criteria="inv.trans==auto"/>
            <fragment text="It features a standard transmission,"
src="transmission/standard.wav" criteria="inv.trans==std"/>
        </list>
        <list min="1" max="1" name="Drive Type" required="true">
            <fragment text="front wheel drive,"
src="wheeldrive/front.wav" criteria="inv.drive==front"/>
            <fragment text="rear wheel drive,"
src="wheeldrive/rear.wav" criteria="inv.drive==rear"/>
        </list>
        <list min="1" max="1" name="Engine" required="true">
            <fragment text="and a 3 liter, 6 cylinder engine."
src="engine/3liter6cylengine.wav"
criteria="inv.liters==3&&inv.cyl==6"/>
            <fragment text="and a 1.6 liter, 4 cylinder engine."
src="engine/1.6liter4cylengine.wav"
criteria="inv.liters==1.6&&inv.cyl==4"/>
            <fragment text="and a 5.2 liter, V-8 engine."
src="engine/5.2liter8cylengine.wav"
criteria="inv.liters==5.2&&inv.cyl==8"/>
        </list>
    </paragraph>

    <fragment silence="0.2"/>

    <paragraph name="Features" required="false" weight="20">
        <fragment text="The following features are included:"
src="..."/>
        <fragment silence="0.2"/>
        <list min="2" max="10" name="featuresList" required="true">
            <fragment text="power windows,"
src="features/powerwindows.wav" criteria="inv.powerwindows==true"
weight="20" silence="0.1"/>
                ... all features listed here...
        </list>
        <list min="1" max="1" name="closingFeature" required="true">
            <fragment text="and a CD player which plays MP3s"
src="features/cdplayer_mp3.wav" criteria="inv.CD==true&&inv.mp3==true"
weight="15" silence="0.1"/>
            <fragment text="and a CD player and AM/FM radio"
src="features/cdplayer_amfm.wav"
criteria="inv.CD==true&&inv.amfm==true" weight="20" silence="0.1"/>
        </list>
    </paragraph>
</scriptTemplate>
```

FIG. 1b

Voice Recording List

| Folder | Filename | Spoken content | Annunciation |
|---|---|---|---|
| yearintro | 2007.wav | This 2007 | leading |
| yearintro | 2008.wav | This 2008 | leading |
| yearintro | 2009.wav | This 2009 | leading |
| yearintro | 2010.wav | This 2010 | leading |
| makemodelbody | bmw328isedan.wav | BMW 328 I Sedan. | closing |
| makemodelbody | hondaaccord.wav | Honda Accord. | closing |
| makemodelbody | dodgedakotatruckstandardcab.wav | Dodge Dakota Truck Standard Cab. | closing |
| makemodelbody | nissan200sxcoupe.wav | Nissan 200 SX Coupe. | closing |
| doors | 4door5pass.wav | This 4 door, 5 passenger vehicle | leading |
| doors | 4door.wav | This 4 door vehicle | leading |
| doors | 2door.wav | This 2 door vehicle | leading |
| mileage | less10000.wav | has less than 10,000 miles. | closing |
| mileage | less5000.wav | has less than 10,000 miles. | closing |
| mileage | warranty.wav | is still under manufacturer's warranty | closing |
| mileage | value.wav | provides exceptional value | closing |
| transmission | automatic.wav | It features automatic transmission, | leading |
| transmission | standard.wav | It features standard transmission, | leading |
| wheeldrive | front.wav | front wheel drive, | list item |
| wheeldrive | rear.wav | rear wheel drive, | list item |
| engine | 3liter6cylengine.wav | and a 3 liter, 6 cylinder engine. | closing |
| engine | 1.6liter4cylengine.wav | and a 1.6 liter, 4 cylinder engine | closing |
| engine | 5.2literv8engine.wav | and a 5.2 liter, V-8 engine | closing |
| features | featuresintro.wav | The following features are included: | leading |
| features | gps.wav | GPS navigation | list item |
| features | keylessentry.wav | remote keyless entry, | list item |
| features | powersunroof.wav | power sunroof, | list item |
| features | powerwindows.wav | power windows, | list item |
| features | powerwindowsmirroslocks.wav | power windows, mirrors, and door locks, | list item |
| features | rainsensingwipers.wav | rain sensing wipers, | list item |
| features | cdplayer_amfm.wav | and a CD player and AM/FM radio. | closing |
| features | cdplayer_mp3.wav | and a CD player which plays MP3s. | closing |
| additional | antitheft.wav | Antitheft devices will protect you from burglars. | sentence |
| additional | stability.wav | Stability control will stabilize your driving. | sentence |
| outro | callnow.wav | Call now to schedule a test-drive today! | sentence |

FIG. 2

AUTOMATIC CREATION OF AUDIO FILES

FIELD

This patent application generally relates to a programmable computer system. More particularly, it relates to a system that automatically creates audio files. Even more particularly, it relates to a system that creates a natural sounding human voice recording describing products or processes.

BACKGROUND

The world wide web has provided the possibility of providing useful written, audio, and visual information about a product that is offered for sale, such as real estate, as described in "Automatic Audio Content Creation and Delivery System," PCT/AU2006/000547, Publication Number WO 2006/116796, to Steven Mitchell, et al, published 9 Nov. 2006 ("the '547 PCT application"). The '547 PCT application describes an information system that takes in information from clients and uses this information to automatically create a useful written description and matching spoken audible electronic signal, and in certain cases a matching visual graphical display, relating to the subject matter to be communicated to users. The information system transmits this information to users using various communications channels, including but not limited to the public telephone system, the internet and various retail ("in-store" or "shop window" based) audio-visual display units. A particular aspect of the '547 PCT application relates to an automated information system that creates useful written descriptions and spoken audio electronic signals relating to real estate assets being offered for sale or lease.

US Patent Application 2008/019845, "System and Method for Generating Advertisements for Use in Broadcast Media, to Charles M. Hengel et al, filed 3 May 2007 ("the '845 application), describes systems and methods for generating advertisements for use in broadcast media. The method comprises receiving an advertisement script at an online system; receiving a selection indicating a voice characteristic; and converting the advertisement script to an audio track using the selected voice characteristic.

Applicants recognized that a better scheme is needed to automatically create audio descriptions, and this solution is provided by the following description.

SUMMARY

One aspect of the present patent application is a method of building an audio description of a particular product of a class of products. The method includes providing a plurality of human voice recordings, wherein each of the human voice recordings includes audio corresponding to an attribute value common to many of the products. The method also includes automatically obtaining attribute values of the particular product, wherein the attribute values reside electronically. The method also includes automatically applying a plurality of rules for selecting a subset of the human voice recordings that correspond to the obtained attribute values and automatically stitching the selected subset of human voice recordings together to provide a voiceover product description of the particular product.

Another aspect is a computer-usable medium having computer readable instructions stored thereon for execution by a processor to perform a method of building an audio description of a particular product corresponding to the above method.

Another aspect of the present patent application is a method of building an audio description of a particular process of a class of processes. The method includes providing a plurality of human voice recordings, wherein each of the human voice recordings includes audio corresponding to an attribute value common to many of the processes. The method also includes automatically obtaining attribute values of the particular process, wherein the attribute values reside electronically. The method also includes automatically applying a plurality of rules for selecting a subset of the human voice recordings that correspond to the obtained attribute values and automatically stitching the selected subset of human voice recordings together to provide a voiceover process description of the particular process.

Another aspect is a computer-usable medium having computer readable instructions stored thereon for execution by a processor to perform a method of building an audio description of a particular process corresponding to the above method.

BRIEF DESCRIPTION OF THE DRAWINGS

The foregoing will be apparent from the following detailed description, as illustrated in the accompanying drawings, in which:

FIGS. 1*a*, 1*b* illustrate template XML written with rules to specify all the fragments included in a common template that may be used to create the voiceover product description of a vehicle;

FIG. 2 illustrates a list of audio fragments that provide human voice descriptions of the attribute values of the vehicle in which each audio fragment is located in a separate digital WAV file, including the content and prosody of each audio fragment.

DETAILED DESCRIPTION

Figure 3:
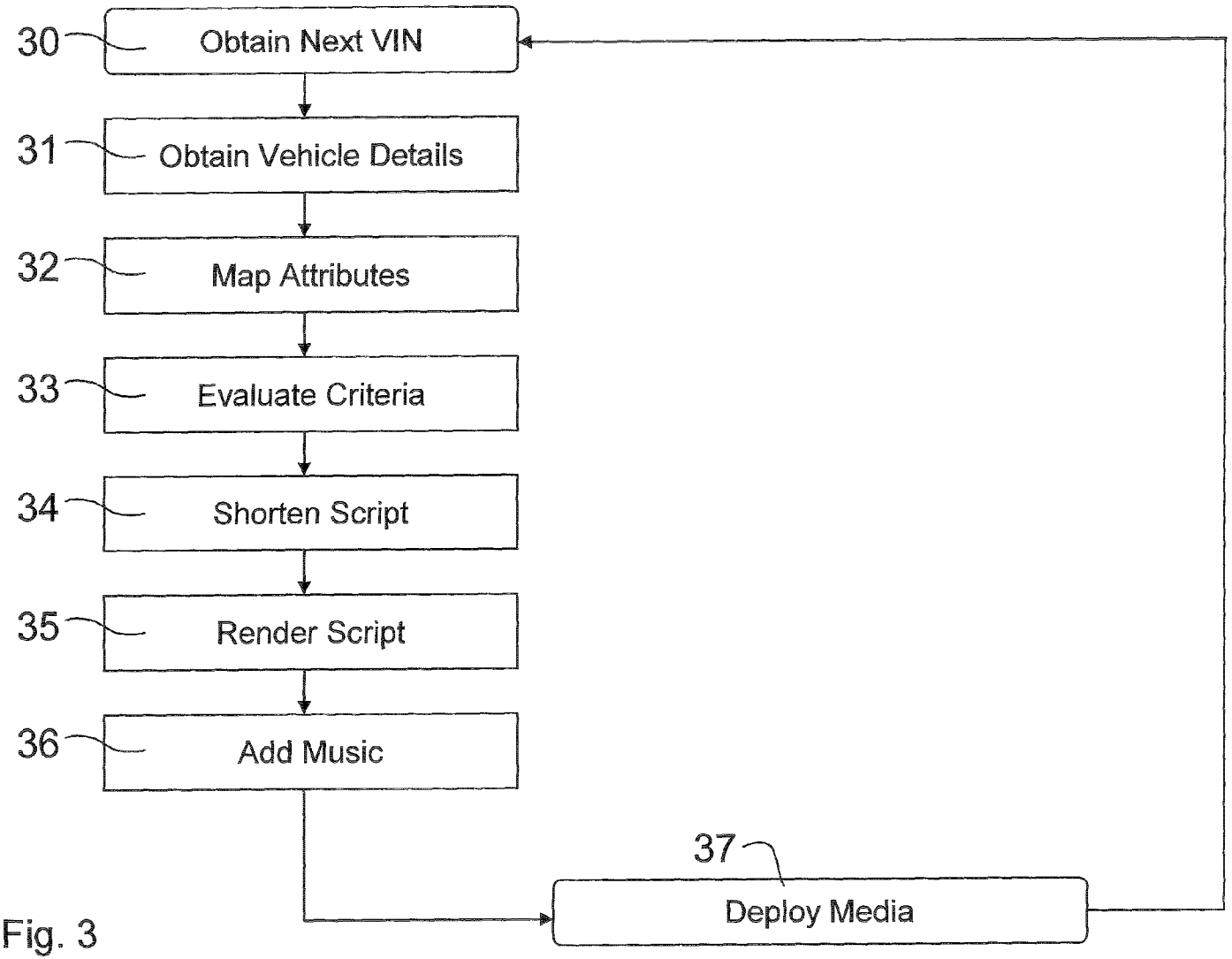
FIG. 3 is a flow chart illustrating the automatic steps repeated over and over again for different vehicles, each without human intervention.

The present applicants automatically created an audio file that contains a natural sounding human voice description of a product, such as a specific automobile. The voice description included a sequence of stitched together audio fragments that describe the particular features, or attribute values, of the specific automobile. The automatic creation scheme obtains the attribute values of each specific automobile from information that resides electronically.

The method described in this patent application provides the equivalent of a factory that generates thousands of entire audio descriptions with no human intervention.

In this patent application, the term "attribute" refers to a feature of a product or process that can be one of several choices.

The term "attribute value" refers to the specific one of the different choices of an attribute.

The term "voiceover product description" refers to a human voice audio description of a specific product or process.

The term "fragment" refers to one or more words intended to be spoken in order as part of a voiceover product description or voiceover process description.

The term "audio fragment" refers to an audio file containing a fragment that was recorded by a human.

The term "stitch" as used in this patent application refers to the process of concatenating audio fragments, for example, to produce the voiceover product or process description. For stitching two or more audio fragments together the audio fragments and their order are specified and their contents stored in a single output file that includes all of the content from the audio fragments, non-overlapping, and in the specified order. The term stitch is also used referring to the similar process of concatenating video files.

The term "stitching point" refers to the point where two audio fragments are stitched together.

The term "automatic" refers to a process executed by a computer with no human intervention.

While the system described in the '547 PCT application required a human to answer questions about a specific product, and while the system described in the '845 application required that a script be provided for the advertisement to be broadcast, the present applicants found that they could eliminate the need for human input and eliminate the need for an input script to generate the content of the natural sounding voiceover product description for each specific vehicle.

In one embodiment, the present applicants found that they could obtain a complete product description of the specific new or used vehicle from an electronically available source. They could find the needed attribute values based on a product identification code, such as a Vehicle Identification Number (VIN). For other types of products, such as electronic devices, equipment, appliances, and real estate, the product serial number, product model number, or real estate code number could be used to locate product description information that resides electronically.

The present applicants found that they could obtain all the attribute values they needed for the audio description of a vehicle, including model year, number of doors, body style, and type of engine, in established fields of one or more online data sources that are available electronically. For example, they could obtain attribute values from an online database, an XML file, or a web page. To obtain attribute values from a web page, a web scraping program may be used. Web scraping involves extracting content from a website for the purpose of transforming that content into a format suitable for use in another context. One example is to download the page via HTTP, search the text in the page for patterns indicating attribute values, and extract the values from the page. They could use an Application Programmer Interface (API), which allows software to obtain data from a remote electronic data source. Thus, the present applicants found that human input to answer questions about a product or to generate a script about the product was avoided.

The present applicants also found that the process they developed for automatically creating natural sounding audio voiceover product descriptions could be used to automatically generate thousands of different voiceover product descriptions for thousands of different products. In a first part of this process that involves human setup, a person records hundreds of audio fragments according to a common template. Then, in the automatic part of this process, these audio fragments are stitched together to provide the voiceover product descriptions that are saved for future playing by a potential customer. The voiceover product description for each vehicle includes a unique audio description of that vehicle with the unique attribute values of that specific vehicle. The automatic part continues by generating thousands of these voiceover product descriptions that can be stored for later selection and playback.

The present applicants accomplished this by having a human being record each of the hundreds of audio fragments needed for the natural sounding audio in separate audio files. They then provided a computer running a program that automatically chose and stitched together a relatively small number of these human voice recordings for the audio description of a specific vehicle. The computer program chose those human voice recordings that described the actual attribute values of that specific vehicle. The actual attribute values were obtained from the electronic data sources that contained the information for that specific vehicle.

To provide the natural sounding audio, the present applicants found a way to provide an authentic and believable prosody, timing, and context recognition to all the words in the voiceover product description. Prosody includes the rhythm, stress, and intonation of speech. Prosody may reflect the emotional state of a speaker; whether an utterance is a statement, a question, or a command; whether the speaker is being ironic or sarcastic; emphasis, contrast and focus; and other elements of language which may not be encoded by grammar.

In one embodiment of this patent application, the present applicants generated a common template for all the voiceover product descriptions. The common template for all the voiceover product descriptions allowed use of authentic and believable prosody in audio fragments because each audio fragment was recorded in the context of its position within the common template. The voice talented person recording each audio fragment according to the common template was thus not recording each audio fragment in isolation. She was recording each audio fragment knowing what came before and what was coming after. Thus, she spoke each audio fragment with authenticity and commitment to a specific context.

For example, the voiceover product description:

> "This four door sedan features a four speed transmission and front wheel drive. It has a 2.4 liter engine, a sunroof, mag wheels, and a spoiler,"

can be built up from audio fragments found in separate audio recordings, each of which was recorded once with the proper prosody for its position in the common template. Each of these audio fragments may have a different content and thus a different prosody. For example, in the above illustration, "and a spoiler" comes at the end of a list. For this audio fragment, the word "and" would be included and the prosody provided by the speaker would have a list-ending sound. Multiple audio fragments may be created to describe the same vehicle attribute or attributes. For example, a fragment "a spoiler" may be recorded to be used in the middle of the list, and the separate recording for that position in a list would sound quite different from its sound at the end of the list.

Each sentence in the template is referred to as a "sentence template". The present applicants also found that they could design each sentence template strategically so that stitching points occurred where human language would naturally include a pause. For example, the previous example might be revised as follows:

> "This four door sedan has a powerful engine, ~including a four speed transmission and front wheel drive. ~It includes each of the following features: ~a 2.4 liter engine, ~a sunroof, ~mag wheels, ~and a spoiler,"

The "~" character indicates the intended stitch points, each occurring in a place where a pause would sound natural, greatly increasing the authenticity of the resultant voiceover product description.

Also the fragment "including a four speed transmission and front wheel drive" corresponds to two attributes, transmission type and drive type. In this instance, the person generating the common template decided that it would be beneficial to combine these attributes into one fragment to further minimize the number of stitch points. This decision was based partly on the fact that there are relatively few combinations of these attributes so few additional audio fragments would need to be recorded.

In one embodiment, the automatic program sequentially and automatically selects multiple audio fragments which are applicable to the particular vehicle, by evaluating criteria against the obtained particular vehicle attributes, and by applying rules in the template XML. The program then stitches those audio fragments together to assemble the voiceover product description.

For a new car, all the needed information may available electronically from the manufacturer based on VIN.

For a used car, additional information can be added from online data bases, such as those that provide accident history information. Thus, if this attribute is provided in the common template, an audio fragment such as, "this vehicle has never been in an accident," or "this vehicle has only seen minor scratches," can be included in the audio based on data that resides electronically in an online accident history data base.

Information is often provided electronically when a used car is added to a dealer inventory, including VIN, mileage, whether the vehicle has any dents or scratches, dealer enhancements, and photographs. Information in this dealer inventory data base can also be drawn upon for audio description creation. Thus, the full audio description can include up to date information about the used vehicle, such as, "this car has been driven fewer than 25,000 miles," and "this car has dealer installed rust proof undercoating."

The setup part of the process described in this patent application is performed by humans, and it provides voice recordings and directions for using the voice recordings that will be used to assemble the voiceover product descriptions for all the various specific products. The directions include specifying the contents of a common template and specifying rules for inclusion of audio fragments in the voiceover product description.

The automated part of the process is performed by a computer running software that can be configured to execute the automated steps for many different vehicles with no human intervention to provide a voiceover product description for each of the specific vehicles. More than one computer can be used to provide parallel processing and faster creation of the thousands of voiceover product descriptions needed to describe thousands of vehicles.

The present applicants recognized that the number of different car possibilities far exceeds the number of different variable elements for a car. For example, there are about 30 different car manufacturers and 3 different door configurations which gives 90 different car combinations possible for just those two attributes. Yet there are only 33 different individual attribute values.

An actual car can have about 50 different relevant attributes that might be of interest to a customer, and can be varied by the manufacturer or by the dealer, including year, manufacturer, model, color, body style, doors, transmission, wheel drive, engine type, engine size, number of cylinders, air conditioning, power sun roof, power windows, power windows, mirrors, and door locks, keyless entry, rain sensing wipers, spoiler, roof rack, upholstery, CD player, radio, antitheft devices, stability control, antilock brakes, and warrantee.

Since many of these attributes can be chosen independently of the others, this means that millions or billions of combinations of these 50 different relevant attributes can be chosen. However, even if there are an average of ten choices for each attribute value, for about 50 attributes there are only about 500 different individual attribute values altogether. Thus, by making only about 500 voice recordings the present applicants recognized that, with appropriate automatic stitching, they could create human voice descriptions of any of the possible car combinations. Based on the information in the data base for a particular VIN, appropriate ones of the 500 voice recordings can be selected and stitched together to automatically provide the description of any particular vehicle that can have any of those millions or billions of car possibilities. The present applicants recognized that they could therefore create a relatively small number of human voice recordings during setup and then, based on information obtained electronically from the VIN, automatically stitch together the appropriate voice recordings to make an accurate audio voiceover product description of any car or truck or for any other type of product or process.

One embodiment of the setup part of the process involves the following five steps.

Setup Step 1: Common Template Creation

The common template creation process creates a framework that facilitates a natural sounding human voice description of the product.

Sample Vehicle Description Common Template

The [Year] [Make/Model/Bodystyle]. This [Doors] [Mileage]. It features a(n) [Transmission], [Wheel Drive] and a(n) [Engine Specs]. The following features are included: [list Features] and [Features Closer]. [Additional Notes (if applicable)] [Outro]

This common template provides the structure for all descriptions of all vehicles generated in this example. The template includes words that are always present and specifies the fragments and the order of the fragments that will be included in the voiceover product description that will be automatically generated. In this example, the fragments included are those describing the year, make, model, bodystyle, number of doors, the mileage if it is a used car, the transmission type, whether it has front or rear wheel drive, the engine type and size, and a list of the vehicle's features. The list of features ends with a closing feature. Additional notes can be included. The last fragment of the common template, the "outro," is a closing remark.

The common template can also include additional information about the vehicle if applicable, such as whether it was ever in an accident. The common template also ends with a closing remark. Silences may be included in the common template to separate different pieces of information.

Setup Step 2: Template XML

The template XML, as shown in FIGS. 1*a*, 1*b*, is written with rules to specify all fragments included in the common template that may be used in the full audio description. In the additional example of template XML given below, the rules specify which fragments are used to describe a particular vehicle. For example:

criteria=" . . . " indicates criteria that must be true for the fragment to be used max="1" indicates that only one element from the list will be used min="1" indicates that at least one element from the list must be used, otherwise the list is not valid required="true" indicates that the element must be valid for its parent element to be valid weight=" . . . " indicates a weight which may be used to select elements over other elements with lower weight Setup Step 3: Voice Recording A human with voice talent will record multiple audio fragments corresponding to each of the fragments in the common template, and these audio fragments will be saved in individual digital voice files, such as .wav files, as shown in FIG. 2.

The human records the audio annunciated in a manner appropriate for its position in the sentence and for its intended usage.

Setup Step 4: Configure Queue Source

In this embodiment of the present patent application, a user populates a queue with the Vehicle Identification Numbers (VINs) of all vehicles in participating car dealers' inventories. VIN numbers will be taken from this queue sequentially by the automatic rendering software (ARS). The VIN numbers will be used by the software to extract specific information about the vehicle from sources of electronic data.

Setup Step 5: Initiate Automated Rendering Software (ARS)

The final setup step in this embodiment is to initiate the Automated Rendering Software which was programmed to perform all automatic steps below over and over again for different vehicles, as shown in FIG. 3, each without human intervention. The software prepared by the present applicants was written in Java and deployed to a cloud computing network for scalability, reliability, and performance. Other programs can also be used.

Automatic Part of the Process

In the automatic steps described below, for a vehicle having a particular VIN, the computer will find the vehicle's attribute value for each attribute that appears in the common template. For example, the computer will find the actual model year of the particular vehicle, as provided in data residing electronically based on that particular VIN. The computer will apply rules to determine which audio fragments are applicable with that particular vehicle based on its attribute values. When the computer determines the model year of the vehicle with that particular VIN it will not include fragments in the result that indicate other model years.

In an alternative embodiment, ARS pulls multiple VINs and generates multiple audio files at one time by using parallel computer resources. As the computer software completes each audio file with the full set of processes in the flow chart of FIG. 3, the software pulls the next VIN from the queue, as shown in box 30.

Automatic Step 1: Obtain Next VIN

ARS pulls the first VIN from the queue, as shown in box 30 of the flow chart in FIG. 3.

Automatic Step 2: Obtain Vehicle Details

Vehicle elements can be obtained based on the vehicle VIN, in ways including VIN decoding and third-party lookups, as shown in box 31. A combination of techniques can be used.

VIN decoding recognizes that the characters of the VIN itself include information about the vehicle, including the year, make, model, and other equipment specifications. A program running on the computer can perform this decoding based on the known digit sequence in the VIN.

Third-party lookups involve the computer system providing the VIN to a third-party database such as Autodata, Inc. or Carfax, Inc., under the direction of the ARS or another integrated program. Autodata, Inc. returns features and specifications about the vehicle identified by the VIN that are in its dataset. Carfax, Inc., provides an API to obtain details of the vehicle's accident history. Other industry web sites also allow automatic access to information about a vehicle based on a VIN.

Automatic Step 3: Map Attributes

Because the vehicle details are represented in different formats by the different third-party providers, a mapping step is used to consolidate and organize the attributes, as shown in box 32.

For each attribute that is referenced in the template XML, such as model year, make, and mileage, the ARS computer software attempts to extract a corresponding value of that attribute from the data sources obtained in the previous step. In the embodiment implemented in the ARS code, data formats of the information providers are relied upon. Other schemes can be used as well, including string searches and pattern matching. In cases where an attribute cannot be located, or no entry is found for that attribute, the attribute value is simply omitted from the mapping.

Automatic Step 4: Implement the Rules

The ARS software running on the computer uses the template XML to generate a result list of applicable audio fragments that describes the specific vehicle identified by its VIN.

In one embodiment, the ARS software creates a copy of the template XML, called the result XML, and sequentially removes elements of the result XML that it finds inapplicable to the current vehicle as each rule is applied, as shown in box 33. The result XML becomes a specific XML for that vehicle that includes only the applicable XML elements. Those XML elements reference applicable audio fragments for inclusion in the voiceover product description.

The following are examples of rules that may be applied:

Rule example 1: If the criteria for an element in the result XML is not true for the product attributes, do not include that element in the result.

Rule example 2: Ensure that no more than max elements are included in the result which are descendants of an element which specifies a max attribute. When more than max elements are available, remove the ones with the lowest weight.

In other embodiments other rules could be used to specify how ARS generates the result.

Automatic Step 5: Shorten the List of Audio Files for the Voiceover Product Description Additional rules provide for ensuring that the resulting voiceover product description does not exceed a designated duration, as shown in box 34. In one embodiment, the output is kept sufficiently short by removing paragraphs and audio fragments that have the lowest weight. Durations of all fragments referenced in the result XML are summed, and if the duration exceeds a given value, XML elements are automatically removed, starting with the one with the lowest weight that is consistent with other rules.

The computer goes through the result XML from top to bottom and creates a list of audio fragments that are referenced by the XML elements.

The result of this step is a tailored shortened list of audio files for use in creating the completed output file that provides the voiceover product description.

Automatic Step 6: Render to Provide the Completed Output File

The tailored and shortened list of audio files resulting from the above steps can now be stitched together to provide the final voiceover product description, as shown in box 35.

For example, an ordered list of files left after the tailoring and shortening steps in one embodiment might look like this:

2008.wav+hondaaccord.wav+4door5pass.wav+ less10000.wav+automatic.wav+front.wav+ 3liters6cylinders.wav+featuresintro.wav+powersunroof.wav+rainsensingwipers.wav+cdplayer_mp3.wav+ stability.wav+callnow.wav The computer running the ARS software then stitches the "wav" files together in the order specified above.

The result of this step is a single "wav" file with an authentic sounding human voice description of the vehicle. Based on the stitched together files, that voice description might say, "This 2008 Honda Accord has 4 doors and room for 5 passengers. It has less than 10,000 miles, an automatic transmission, front wheel drive, and a 3 liter, 6 cylinder engine. It features a power sun roof, rain sensing wipers, a CD player with MP3 capability, and stabilizers. Call now to take a test drive."

Automatic Step 7: Add Music

We may automatically select one of many music tracks and mix them into the final audio as background music, as shown in box 36. Music tracks can be selected randomly from a list of music tracks. A selection process can be used as well, using rules, for example, that provide that certain music tracks are used for trucks and others are for sedans.

Automatic Step 8: Transfer to Web Server

ARS then transfers the resultant audio file to a web server, making it available to vehicle shoppers in a web-based vehicle inventory system.

In other embodiments the resultant audio file may be combined with corresponding video portion to create an audio/video presentation, as shown in box 37. The video portion may be automatically created from visual sources, including images, video clips, and text. In one embodiment, photograph images are automatically obtained from a dealer inventory database, and they are used in the order they are found, each for a specified period of time, such as 6 seconds.

In another embodiment, a computer can be used to:

1. automatically obtain applicable visual sources as described below based on VIN number and product attributes.
2. select a subset of the sources based on rules.
3. determine an order and timing based on rules.
4. stitch the visual sources together into a result video portion.
5. create an audio/video file containing this result video portion as a video track and the voiceover as an audio track playing simultaneously.

Example Rules:

1. 6 seconds per source
2. Keep the sources in the same order as they were obtained
3. Match the duration of the video portion to the duration of the audio portion
4. If there are not enough sources, repeat them as necessary
5. If there are too many sources, only use as many as needed.

If the voiceover is 60 secs long, we will require 10 sources at 6 seconds per source. If there are 8 sources: s1, s2, s3, s4, s5, s6, s7, s8 then the sources will be used as follows: s1, s2, s3, s4, s5, s6, s7, s8, s1, s2.

During later playback of the audio/video file, a customer will see the video portion at the same time the voiceover is playing. In one embodiment, in creation of the video portion, the likelihood is increased that images of product features are displayed at the same time those features are described by the voiceover (referred to as "synchronization"). One way to synchronize visual elements with applicable parts of the voiceover is to use ARS to render the voiceover first and store specific topics and the time in the voiceover that they are mentioned. The topic information can be obtained from the template. ARS will subsequently create the video portion, matching video assets to specific time locations based on their content.

In cases where the content of the images is not known, the template is designed in a way to discuss features in an order that they are most likely to occur in the images.

Visual sources including images, video clips, and text are used to automatically create the video portion with various combinations of timing, effects, and transitions. In this embodiment, the video portion and audio voiceover are combined automatically by media processing software into a web streaming audio/video file in a format such as .FLV. The same five steps listed above are followed. In step 3 the rule would provide timing of the video portion matched up with timing of audio fragments from the voiceover creation.

Some audio/video formats (including FLV) allow metadata to be embedded directly in the file, specifying "cuepoints". In one embodiment, ARS is programmed to add a cuepoint to the audio/video file to mark the specific time when the voiceover is describing the engine. The web page uses a web technology, such as Adobe Flash to display a desired engine effect, such as a text description or an animation showing pistons moving, at the exact moment the cuepoint was detected while playing the audio/video file.

The term "cuepoint" refers to metadata which is embedded in a media file to describe content appearing at a specific time. In one embodiment, audio fragments are grouped into paragraphs which may include a name (i.e. paragraph name="Engine") ARS may be programmed to automatically add cuepoints to the audio/video file at the specific time each paragraph starts. This might be accomplished by:

1. While compiling the list of audio fragments to use in the result voiceover, keep a running total of the durations of all previous audio fragments (the "time position"). Each time a new paragraph is encountered, store the time position along with the paragraph name.
2. Once the audio/video file has been created, use a media processing utility to add a cuepoint to the audio/video file for each paragraph. The cuepoints would include the name of the paragraph.

This technique can be later used to trigger events on the web page which plays the audio/video file. For example, the audio/video file is played on the left side of the web page while text is shown on the right side of the web page. The web page can be programmed to execute code each time a cuepoint is encountered while playing the audio/video file. This code would change the technical specs on the right side of the page when a recognized cuepoint was encountered.

Visual Sources

Visual sources, such as photographs or video clips, can be obtained from a third-party source based on VIN, and an API can also be used to access this data. Alternatively, stock vehicle footage for various makes/models of cars can be used. Such footage can be accessed using a file transfer protocol (FTP) server provided by a third-party. This server and login credentials, such as user name and password, would be accessible to ARS while processing. In one embodiment, the third-party provides documented naming conventions and ARS is programmed to automatically seek the correct named stock footage based on the attributes of a vehicle found from a previous search based on VIN.

Rules can be provided in the template or in the ARS program, as described herein above, for acquiring and using the images. Images from several sources can used to automatically generate the video portion.

Images

A video portion may be created from vehicle images, such as photographs, which are automatically obtained based on VIN number from a dealer website or dealer management system API. In one embodiment, these images are used to automatically create a video presentation as in a slideshow, in which for example, each image is displayed for 6 seconds, with a dissolve transition applied between each image.

In some cases, images are used in the order they are found. Because images are typically obtained in the order they were shot, they will often have a predictable order with exterior shots first, then interior shots, then technical shots, such as the engine. The present applicants provide for increased synchronization by designing the template to discuss the exterior features first, then interior, then the engine.

Consistent photography practices are currently in use that provide that every vehicle across many dealerships will have the same number of images ordered identically. For example, exterior front, exterior rear, interior steering wheel, interior dashboard, engine, etc. When the specific order is known, the image order and timing in the slideshow can be set to display images synchronized to the voiceover product description. For example, if we know that image 8 is the engine and image 14 is the stereo, and the slideshow discusses the engine from 0:21 to 0:27 and the stereo from 0:27 to 0:36, then the program will set the video portion to show image 8 from 0:21 to 0:27 and image 14 from 0:27 to 0:36.

Sometimes the content of an image can be inferred from the name of the file or from metadata—information about the image entered by its creator and stored in the image file. In these cases, a recognized file name or image metadata, like "engine" would indicate that the image should synchronized with the engine paragraph of the voiceover product description.

Video Clips

A video portion may also be created from video clips, which are automatically obtained from a dealer website or dealer management system API based on VIN number. In one embodiment, these video clips are used to automatically create the video portion in a slideshow manner where each clip is displayed for a portion of its duration, with dissolve transitions applied between each.

Stock footage is generic footage that may be generally applied to all products which match certain criteria. For example, stock video footage of a Toyota Avalon may be displayed for any product that matches criteria make=Toyota and model=Avalon. Text could accompany the footage disclosing that the stock footage is not of the actual product being described but of a product of the same make and model. More general footage might demonstrate engine pistons firing and could be used in any vehicle video portion.

Text Effects

Text effects can be automatically added to specify information about the vehicle. The text can be provided in the setup steps as part of the template, and specific information can be automatically obtained from the vehicle attributes during the rendering process. For example, the template might reference a mileage effect, which slides text with the vehicle mileage out onto the screen. The engine specs could be shown as text in the video portion at the same time as the engine is being discussed in the voiceover. In one embodiment, the template would include a flag for the "engine" audio paragraph. ARS would be programmed to store the time in the voiceover at which the "engine" audio paragraph starts, and it would add the "engine" text effect to the video portion at that corresponding time location.

Text about the dealership, phone numbers, special offers, and images of the dealership could also be added to the video portion at appropriate times. This is achieved by programming ARS to automatically obtain attributes of the dealership in the same way it obtains attribute values of the vehicle. "Marketing blurbs" are included in the template with rules on when to use them. For example, text stating, "Making complex technology easy to use. It's what moves us to advance." Could be specified in the template with a rule, such as:

<fragment text="Making complex technology easy to use. Its what moves us to advance." src="marketing/acura.wav" criteria="make=='Acura'" weight="15"/>

In the embodiment described herein above, thousands of audio/video files may be generated automatically based on lists of VIN numbers. At a later time, users visiting a web page for a specific vehicle will be provided the corresponding audio/video file that was already generated based on its VIN number. In one embodiment multiple audio/video files are generated and stored for each VIN number, each using a different template which provided different rules or audio fragments for its generation, for example, to adapt to user demographics. Thus, multiple languages can be provided. A male version and a female version can also be provided.

In another embodiment, audio/video files are generated dynamically, which means at the time they are needed. They can then be customized for the specific customer. Steps to provide dynamic generation are:

A. Configure a web server to gather and store details of each user's web session.
   These details may include:
   1 Search string—When a customer visits a site by clicking Google search results, Google passes information about the users' search string in the URL.
   2 Customer Information—The customer may have provided information such as customer name, price range, vehicle interests and preferences, in the current session or in a previous session via a login or cookie.
   3 Location and demographics—The customer's information may be obtained by IP address using third-party geographic and demographic databases.
B. Configure the web server to trigger ARS at a specified point in the web page interaction process. For example, when a user selects a vehicle in a search list, ARS is automatically notified that an audio/video file is needed.
C. ARS automatically constructs the audio/video file using the same techniques as previously described, however additional attributes are available which may result in a more customized audio/video file. For example:
   <fragment text="This could be just the right vehicle for you, Mike." src="firstnames/mike.wav" criteria="user.firstname=='Mike'" weight="15"/>
D. In one embodiment, the web page uses a technique, such as a Java script in XML (AJAX) request to poll for the audio/video file's availability. Once it is available, it appears on the web page with a button "Click to play your video."

Providing an Interface to the Software which can be Embedded on a Web Page

One way of using the software of the present patent application is: Create a web widget, a portable piece of code that can be embedded in a user's web page, such as an auto dealer or a person selling a used car. Instructions for how to embed the web widget on any web page and for specifying a VIN in its parameters would be shown along with the web widget. Instructions for including images of the vehicle being offered for sale are also shown. The user would specify the images in parameters of the web widget to be used in the video portion. The web widget is created according to the following steps:

A. Program the widget to send a message to ARS containing the VIN when it is loaded on a web page.
B. Program ARS to create a corresponding audio/video file when the message is received.
C. Program the widget to display the audio/video file once ARS had rendered it.

Languages

In one embodiment, the template includes a language code language="US_EN" at the top. Additional language versions of the template and voiceovers can be generated in the different languages. In one embodiment, voice talent records audio fragments in the new language, and those audio fragments are stored for use when the new language code is specified. In another embodiment, a second version of the template with the different language code is generated to provide adjustments that make the voiceover sound more authentic in the new language.

A. Create a copy of the template and change the language code in the copy to identify the new language.
B. Translate all fragments into the other language
C. Revise the template if necessary to ensure that stitching points occur at natural pauses in the other language.
D. Voice talent records all fragments in the other language In one embodiment, configure ARS to automatically select the proper template based on rules. For example, if dealership country is US, use the US_EN template, if dealership country is the French speaking part of Canada, use CA_FR template. In another embodiment, render and store both language versions of an audio/video file, and allow a user to later select a preferred language version.

In one embodiment, a separate dealer promotional audio/video file is played before or after the vehicle audio/video file. One way this is accomplished is by:

A. Providing a list of dealership codes and corresponding promotional audio/video files to ARS.
B. Programming ARS to automatically stitch the applicable promotional audio/video files before or after the vehicle audio/video file based on the dealership code for each vehicle.

Another way this is accomplished is to program a media player on a web page to play a separate promotional audio/video file before playing the vehicle audio/video file. This technique would not require any additional stitching.

While the current examples have described a process for creating an audio/video file which describes one product, the process can be extended to create a "comparison" audio/video file in which multiple products are described and compared. In one embodiment, each of the products included in the comparison is selected by the customer. One way of implementing this is for the ARS program to stitch together the audio/video product descriptions for each of the products selected for comparison, one after the other. Between the product descriptions, the ARS software is programmed to play a transitional audio fragment that says, for example, "compare with this other vehicle."

In another embodiment comparison is provided interleaved, feature by feature for the vehicles selected. The ARS program can select the second vehicle based on a criterion, such as, less expensive or competing car from another manufacturer. In this embodiment a template is generated that is designed for making a comparison. The template has the following features:

A. For every element described, the template includes mention of which vehicle is being referred to. Each criterion field thus specifies which vehicle it applies to, for example, vehicle1.make='Toyota.'
B. Comparison fragments are included in the template, for example, "If you're looking for a less expensive option, consider this second vehicle . . . " with criteria "vehicle2.price<vehicle1.price"

ARS is programmed to obtain vehicle elements for both vehicles, as described herein above and in box 31 of FIG. 3. These vehicle elements are then mapped into vehicle1 and vehicle2 data sets from which the appropriate audio fragments are selected for inclusion in the product product description.

Different Voices

Audio fragments may be recorded with different voices, here are two examples:

A. Using multiple voices in the same voiceover. For example, male and female alternating paragraphs or having a dialogue exchange (male: Can you tell us about the engine? Female: Sure, it has a V-8 engine)
B. Using multiple voices in separate voiceovers. For example, male records the entire template and female records the entire template. A user visits a web page to view vehicle audio/video files and the web server applies a rule, that may be based on the customer demographics, to determine when the male version is used and when the female version is used.

In another embodiment of the present patent application, the automatically generated voiceover provides an audio description of steps of a process, such as a cooking recipe. A common template for recipes is prepared that includes as attributes the possible steps of a set of recipes. Remarks may also be included in the common template. Each fragment identified in the template is then recorded by a human being with proper prosody.

To obtain the automatically generated voiceover process description, attributes of a particular recipe, including the ingredients used in each step of that recipe, their quantities, and the procedure for performing each step in the recipe, are automatically obtained from an electronic source of recipes, such as an online database based on provision of a name of the recipe or a recipe code number. Software running on a computer is used to apply rules and map these particular attributes of the recipe into a usable data format containing the actual ingredients, their respective quantities, and the steps of preparation, as described for a particular vehicle herein above. For example, a rule would determine that if the recipe called for preheating the oven to 350 degrees. If so, an audio fragment saying "Preheat your oven to 350 degrees" would be used at the beginning of the voiceover. The software would then follow the process described herein above for selecting a set of audio fragments and stitching them together to generate an authentic sounding human voice recording of the recipe instructions.

While several embodiments, together with modifications thereof, have been described in detail herein and illustrated in the accompanying drawings, it will be evident that various further modifications are possible without departing from the scope of the invention as defined in the appended claims. Nothing in the above specification is intended to limit the invention more narrowly than the appended claims. The examples given are intended only to be illustrative rather than exclusive.

What is claimed is:

1. A method of building an audio description of a particular product of a class of products, comprising:

a. providing a plurality of human voice recordings, wherein each said human voice recording includes audio corresponding to an attribute value common to many of the products;
b. automatically obtaining attribute values of the particular product, wherein said attribute values reside electronically;
c. automatically applying a plurality of rules for selecting a subset of said human voice recordings that correspond to said obtained attribute values; and
d. automatically stitching said selected subset of human voice recordings together to provide a voiceover product description of the particular product.

2. The method as recited in claim 1, further comprising repeating steps b, c, and d for a plurality of said particular products.

3. The method as recited in claim 2, wherein said repeating is executed by a computer with no human involvement.

4. The method as recited in claim 3, wherein said repeating is executed by a plurality of computers.

5. The method as recited in claim 3, further comprising configuring a web server to trigger said automatic generation dynamically.

6. The method as recited in claim 3, further comprising configuring a web widget to trigger said automatic generation dynamically.

7. The method as recited in claim 1, wherein the class of products includes at least one from the group consisting of vehicles, appliances, electronic devices, and real estate.

8. The method as recited in claim 1, further comprising providing an identification code to automatically obtain said attribute values that reside electronically.

9. The method as recited in claim 8, wherein said identification code includes at least one from the group consisting of a VIN, a product model number, a product serial number, and a real estate code.

10. The method as recited in claim 1, further comprising providing a common template that includes rules for selecting and ordering said human voice recordings for a voiceover product description.

11. The method as recited in claim 10, further comprising providing said common template with a structure in which ordinary human language includes a natural pause, further comprising providing a first fragment directly before said natural pause and a second fragment directly after said natural pause.

12. The method as recited in claim 10, wherein said common template includes a sentence template, further comprising preparing said sentence template to include a natural pause, further comprising providing a first fragment directly before said natural pause and a second fragment directly after said natural pause.

13. The method as recited in claim 12, wherein a majority of fragments in said sentence template are adjacent at least one said natural pause.

14. The method as recited in claim 13, wherein all fragments in said sentence template are adjacent at least one said natural pause.

15. The method as recited in claim 10, wherein said common template includes a rule to use a particular human voice recording in all voiceover product descriptions.

16. The method as recited in claim 10, further comprising providing rules for inclusion of selected ones of said human voice recordings in said voiceover product description of the particular product.

17. The method as recited in claim 10, wherein each said human voice recording includes audio recorded by a human with a prosody appropriate for its context in said common template.

18. The method as recited in claim 1, wherein at least a pair of said plurality of human voice recordings includes audio corresponding to a single attribute value, wherein a first member of said pair has a first prosody for placement at a list ending and a second member of said pair has a second prosody for placement at other than a list ending.

19. The method as recited in claim 1, wherein one of said human voice recordings includes audio corresponding to a plurality of attribute values.

20. The method as recited in claim 1, wherein said automatically obtaining said attribute values involves obtaining said attribute values from a database.

21. The method as recited in claim 20, wherein said database includes dealer inventory information.

22. The method as recited in claim 1, wherein said automatically obtaining said attribute values involves using an application programmer interface.

23. The method as recited in claim 1, wherein said automatically obtaining said attribute values includes obtaining one said attribute value from a web page that includes information about the product.

24. The method as recited in claim 1, wherein said voiceover product description includes a plurality of different human voices.

25. The method as recited in claim 1, further comprising combining said voiceover product description with music.

26. The method as recited in claim 1, wherein said providing a plurality of human voice recordings includes providing said plurality of human voice recordings in a plurality of languages.

27. The method as recited in claim 1, further comprising combining said voiceover product description with a video portion.

28. The method as recited in claim 27, further comprising automatically generating said video portion from an automatically obtained visual source.

29. The method as recited in claim 28, further comprising generating a plurality of video portions and voiceover product descriptions for a particular product of said class of products.

30. The method as recited in claim 28, wherein said automatically generating said video portion includes stitching visual sources together.

31. The method as recited in claim 28, wherein said automatically generating said video portion includes creating an audio/video file containing said result video portion as an video track and said voiceover product description as an audio track.

32. The method as recited in claim 28, wherein said automatically generating said video portion includes storing a time in said voiceover product description that a specific element is mentioned.

33. The method as recited in claim 28, wherein said automatically generating said video portion includes photograph images.

34. The method as recited in claim 28, wherein said automatically generating said video portion includes showing visual elements during specific points in said voiceover corresponding to audio about those visual elements.

35. The method as recited in claim 28, wherein said automatically generating said video portion includes stock footage.

36. The method as recited in claim 28, wherein said automatically generating said video portion includes generating said video dynamically as it is needed.

37. The method as recited in claim 28, wherein said automatically generating said video portion includes:

a. automatically obtaining visual sources;

b. automatically selecting a subset of said visual sources based on rules;

c. determining an order and timing for a subset of said visual sources based on rules;

d. stitching said subset of said visual sources together into a result video portion; and e. creating an audio/video file containing said result video portion as a video track and said voiceover product description as an audio track.

38. A method of building an audio description of a particular process of a class of processes, comprising:

a. providing a plurality of human voice recordings, wherein each said human voice recording includes audio corresponding to an attribute value common to many of the processes;

b. automatically obtaining attribute values of the particular process, wherein said attribute values reside electronically;

c. automatically applying a plurality of rules for selecting a subset of said human voice recordings that correspond to said obtained attribute values; and d. automatically stitching said selected subset of human voice recordings together to provide a voiceover process description of the particular process.

39. A method of building an audio description of a plurality of particular products of a class of products, comprising:

a. providing a plurality of human voice recordings, wherein each said human voice recording includes audio corresponding to an attribute value common to many of the products;

b. automatically obtaining attribute values of the plurality of particular products, wherein said attribute values reside electronically;

c. automatically applying a plurality of rules for selecting a subset of said human voice recordings that correspond to said obtained attribute values;

and d. automatically stitching said selected subset of human voice recordings together to provide a voiceover product description of the plurality of particular products.

40. The method as recited in claim 39, further comprising providing a transition human voice recording that includes audio corresponding to a transition between products and automatically stitching said transition human voice recording into said voiceover product description of the plurality of particular products.

41. A tangible computer-usable medium having computer readable instructions stored thereon for execution by a processor to perform a method of building an audio description of a particular process of a group of processes, comprising:

a. accessing files containing a plurality of human voice recordings, wherein each said human voice recording includes audio corresponding to an attribute value common to many of the processes;

b. automatically obtaining attribute values of the particular process, wherein said attribute values reside electronically;

c. automatically applying a plurality of rules for selecting a subset of said human voice recordings that correspond to said obtained attribute values; and d. automatically stitching said selected subset of human voice recordings together to provide a voiceover process description of the particular process.

* * * * *

UNITED STATES PATENT AND TRADEMARK OFFICE

CERTIFICATE OF CORRECTION

PATENT NO. : 8,112,279 B2
APPLICATION NO. : 12/192783
DATED : February 7, 2012
INVENTOR(S) : Jamie M. Addessi and Mark Paul Bonfigli It is certified that error appears in the above-identified patent and that said Letters Patent is hereby corrected as shown below:

On the title page, Item (74) Attorney, Agent, or Firm: "James Marc Lees" should be changed to read --James Marc Leas--

Signed and Sealed this
Nineteenth Day of February, 2013

Teresa Stanek Rea
*Acting Director of the United States Patent and Trademark Office*